US007063162B2

(12) United States Patent
Daling et al.

(10) Patent No.: US 7,063,162 B2
(45) Date of Patent: Jun. 20, 2006

(54) METHOD FOR CONTROLLING FLUID FLOW INTO AN OIL AND/OR GAS PRODUCTION WELL

(75) Inventors: Roelof Daling, Rijswijk (NL); Vincent Sebastiaan Droppert, Rijswijk (NL); Johan Dirk Jansen, Rijswijk (NL); Arjen Michiel Wagenvoort, Rijswijk (NL); Carlos Alberto Glandt, Rijswijk (NL); Duncan Ian Green-Armytage, Assen (NL)

(73) Assignee: Shell Oil Company, Houston, TX (US)

( * ) Notice: Subject to any disclaimer, the term of this patent is extended or adjusted under 35 U.S.C. 154(b) by 190 days.

(21) Appl. No.: 10/468,346

(22) PCT Filed: Feb. 19, 2002

(86) PCT No.: PCT/EP02/01791

§ 371 (c)(1),
(2), (4) Date: Aug. 18, 2003

(87) PCT Pub. No.: WO02/066787

PCT Pub. Date: Aug. 29, 2002

(65) Prior Publication Data

US 2004/0094307 A1 May 20, 2004

(30) Foreign Application Priority Data

Feb. 19, 2001 (EP) ..... 01200586

(51) Int. Cl.
*E21B 34/14* (2006.01)

(52) U.S. Cl. ..... 166/373; 166/369

(58) Field of Classification Search ..... 166/313, 166/369, 373, 386, 387, 336, 250.17, 250.15, 166/370

See application file for complete search history.

(56) References Cited

U.S. PATENT DOCUMENTS

| | | | | |
|---|---|---|---|---|
| 4,714,117 | A | 12/1987 | Dech | |
| 5,447,201 | A | 9/1995 | Mohn | |
| 5,535,828 | A | 7/1996 | Kinderen et al. | 166/372 |
| 5,655,605 | A * | 8/1997 | Matthews | 166/370 |
| 5,975,204 | A * | 11/1999 | Tubel et al. | 166/250.15 |
| 6,112,817 | A * | 9/2000 | Voll et al. | 166/373 |
| 6,279,660 | B1 * | 8/2001 | Hay | 166/336 |

FOREIGN PATENT DOCUMENTS

| | | |
|---|---|---|
| EP | 0588421 | 3/1994 |
| GB | 2320938 | 7/1998 |
| GB | 2342665 | 4/2000 |
| WO | 01/11189 | 2/2001 |

OTHER PUBLICATIONS

International Search Report dated May 10, 2002.

* cited by examiner

*Primary Examiner*—David Bagnell
*Assistant Examiner*—Matthew J. Smith
(74) *Attorney, Agent, or Firm*—Rachael A. Stiegel

(57) ABSTRACT

The inflow of fluid from an oil and/or gas bearing formation into an oil and/or gas production well is cyclically moved up and down along the length of an inflow region of the well by cyclically changing the opening of one or more control valves.

6 Claims, 1 Drawing Sheet

METHOD FOR CONTROLLING FLUID FLOW INTO AN OIL AND/OR GAS PRODUCTION WELL

FIELD OF THE INVENTION

The invention relates to a method for controlling fluid flow into an oil and/or gas production well by means of one or more control valves which control the inflow of fluids from the reservoir formation into one or more axially spaced segments of an inflow region of the well.

BACKGROUND OF THE INVENTION

Such a method is known, for example, from U.S. Pat. Nos. 4,714,117 and 5,447,201, European patent application No. 0588421 and from UK patent application No. 2,320,938.

In the methods known from these prior art references the control valve or valves are adjusted such that the production of undesired fluids, such as water and/or gas is reduced and that the inflow of fluids is equalised along the length of the inflow region of the well in a substantially static fashion.

In particular in horizontal wells there is a long horizontal inflow region where production of fluids tends to be larger near the heel of the well than near the toe of the well. As a result of such unequal inflow of fluid the risk of water and/or gas coning and ultimately of water and/or gas breakthrough is larger near the heel than near the toe of the well.

The known inflow equalisation methods indeed reduce the risk of water and/or gas coning near the heel of the well, but they significantly reduce the production rate of the well and do not adequately minimize the amounts of water and/or gas produced after water and/or gas breakthrough has occurred.

It is an object of the present invention to overcome the problems associated with the prior art systems and to provide an oil or gas production method in which the problem of water and/or gas coning and of high fluid influx from highly permeable reservoir strata is reduced with only a minimal reduction of the production rate of the well.

SUMMARY OF THE INVENTION

In the method according to the invention inflow of fluids from the reservoir into one or more axially spaced areas of an inflow region of the well is controlled by one or more control valves of which the opening is cyclically changed.

Preferably the opening of at least one of said valves is cyclically changed in accordance with a selected pattern which influences the inflow profile along the length of the inflow region such that an area of maximum inflow is created which cyclically moves up and down along the length of said inflow region.

Hence, instead of flattening of the inflow profile along the length of the inflow region a peak is created in the inflow profile, which peak cyclically moves up and down along the length of the inflow region.

Such a cyclically moving fluid inflow peak may be accomplished in various ways.

In a first embodiment of the method according to the invention the inflow region of the well comprises a production tubing or liner which is at its outer surface equipped with a number of axially spaced packers which divide an annular space surrounding said tubular into a series of axially spaced hydraulically separated annulus inflow segments and wherein influx of fluid from at least one of said segments into the production tubing or liner is controlled by a valve of which the opening is cyclically changed.

In such case the opening of said valve or valves may be cyclically changed by sequentially switching the valve body between an open and a closed position thereof. Instead of one or more single-position valves, multi-position valves or continuously variable valves may be used.

Alternatively, inflow of fluid from a plurality of axially spaced annular inflow segments is controlled by a plurality of valves which control inflow of fluid from different segments into the interior of the production tubing or liner and of which the openings are cyclically changed such that at least one valve is closed during at least part of a period in which one or more other valves are open.

In a second embodiment of the method according to the invention the inflow region of the well comprises a production tubing having an open lower end in which production tubing an inflow control valve is arranged at a location which is axially spaced from said open lower end and wherein the opening of said inflow control valve is cyclically adjusted in order to vary a point of maximum influx of fluid from the reservoir formation into an annular space surrounding the production tubing cyclically up and down between a location near the valve and a location near the open lower end of the tubing.

In such case the opening of the inflow control valve may be cyclically varied in a substantially sinusoidal pattern.

DETAILED DESCRIPTION OF THE INVENTION

Figure 1:
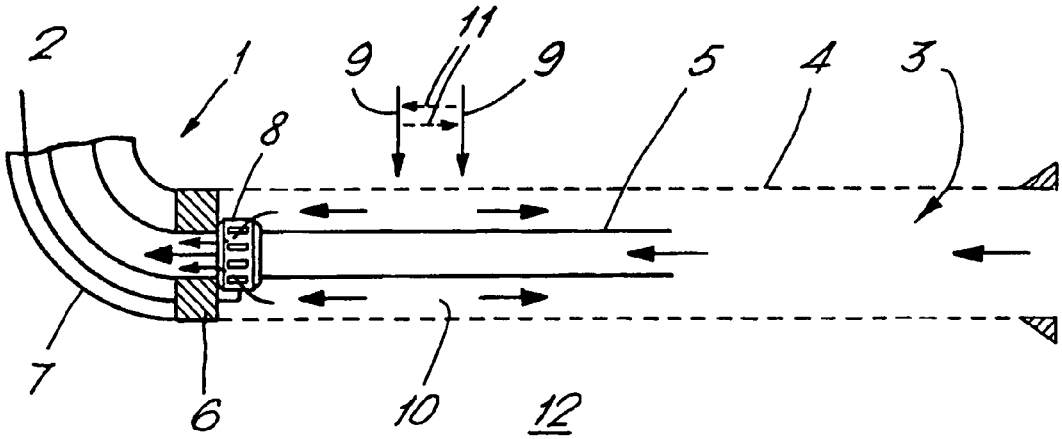
FIG. 1 is a longitudinal sectional view of an inflow region of a well in which fluid inflow is cyclically moved up and down along the length of said inflow region.

Referring now to FIG. 1 there is shown an oil and/or gas production well 1 having a substantially vertical upper section 2 and a substantially horizontal lower section which forms the inflow region 3 of the well. The inflow region 3 may be uncased or equipped with a perforated liner 4. Alternatively the inflow region 3 may be encased by a slotted screen and gravel pack and/or by a predrilled permeable liner.

A production tubing 5 extends into the inflow region 3 through a packer 6 which is located near the heel 7 of the well. An adjustable inflow control valve 8 is located in the production tubing 5 upstream of the packer 6. This valve 8 is cyclically opened and closed, preferably in a continuously variable pattern.

As a result of such cyclic opening and closing of the valve 8 the area 9 of maximum influx of fluid into the annular space 10 between the tubing 5 and perforated liner 4 will cyclically move up and down along at least part of the length of the inflow region 3 as illustrated by the dotted arrows 11.

As a result of said cyclic movement of the area of maximum influx of fluid into the well, the risk of water and/or gas coning in the reservoir formation 12 surrounding the well 1 is reduced in a simple and effective manner.

If desired the packer 6 and inflow control valve 8 may be located in a vertical section of the well, just above the heel 7 in order to facilitate maintenance, inspection and/or replacement of the valve 8 with wireline equipment. The valve 8 may be a wireline retrievable valve which is installed in a side pocket as disclosed in U.S. Pat. No. 5,535,828.

Figure 2:
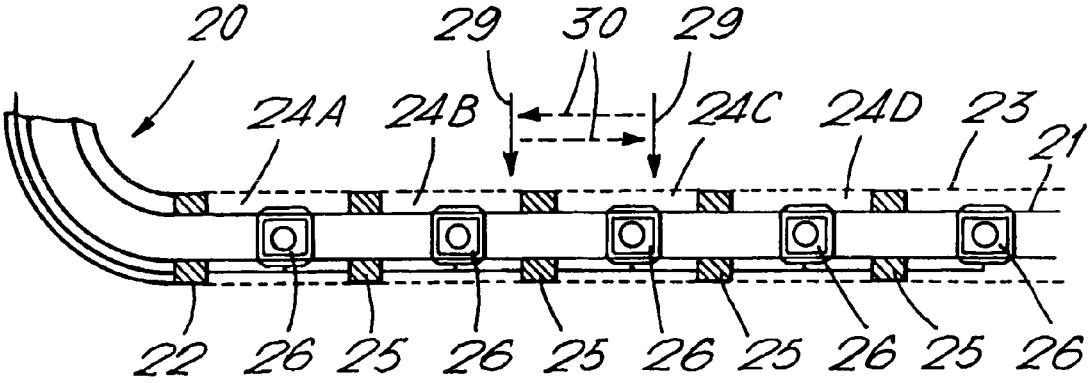
FIG. 2 is a longitudinal sectional view of an inflow region of another well in which fluid inflow is cyclically moved up and down along the length of the inflow region.

FIG. 2 shows an alternative well configuration in which the method according to the invention is applied. In the well 20 shown in FIG. 2 a production tubing 21 extends through a packer 22 into an inflow region which is encased by a perforated liner 23.

The annular space 24 is divided into a series of axially spaced segments 24 A–D, etc. by means of a series of axially spaced packers 25. Between each pair of adjacent packers 25 the tubing is equipped with an inflow control valve 26 which is cyclically opened and closed during production. By cyclically opening and closing the various valves 26 at different moments in time, preferably by sequentially closing the valves 26 in either an upstream or downstream direction the point 29 of maximum fluid influx into the well 20 is cyclically varied as illustrated by the dotted arrows 30.

We claim:

1. A method for controlling fluid flow into an oil and/or gas production well by means of one or more control valves which control the inflow of fluids from the reservoir formation into one or more axially spaced areas of an inflow region of the well, wherein the opening of at least one of said valves is cyclically changed in accordance with a selected pattern which influences the inflow profile along the length of the inflow region such that an area of maximum inflow is created which cyclically moves up and down along the length of said inflow region wherein the opening of at least one of the inflow control valves is cyclically varied in a substantially sinusoidal pattern.

2. The method of claim 1, wherein the inflow region of the well comprises a production tubing or liner which is at its outer surface equipped with a number of axially spaced packers which divide an annular space surrounding said tubular into a series of axially spaced hydraulically separated annulus inflow segments and wherein influx of fluid from at least one of said segments into the production tubing or liner is controlled by a valve of which the opening is cyclically changed.

3. The method of claim 2, wherein the opening of said valve is cyclically changed by switching the valve body between an open and a closed position.

4. The method of claim 3, wherein inflow of fluid from a plurality of axially spaced annular inflow segments is controlled by a plurality of valves which control inflow of fluid from different segments into the interior of the production tubing or liner and of which the openings are cyclically changed such that at least one valve is closed during at least part of a period in which one or more other valves are open.

5. The method of claim 1, wherein the inflow region of the well comprises a production tubing having an open upstream end in which production tubing an inflow control valve is arranged at a location which is axially spaced from said open upstream end and wherein the opening of said inflow control valve is cyclically adjusted in order to vary a point of maximum influx of fluid from the reservoir formation into an annular space surrounding the production tubing cyclically up and down between a location near the valve and a location near the open lower end of the tubing.

6. The method of claim 5, wherein the opening of at least one valve is changed in reaction to the measurement of one or more physical parameters, selected from the group consisting of such as fluid flux, composition, temperature and/or pressure; wherein the most downstream valve is closed, and subsequently the nearest valve upstream of the closed valve is also closed, whereafter the next valve is also closed and said sequence of closing of subsequent valves in upstream direction is continued until only the most upstream valve is open, whereupon all valves are re-opened and the cycle segmentially closing the most downstream valve is repeated at least once.

* * * * *